United States Patent [19]

Vinson

[11] Patent Number: 4,858,669

[45] Date of Patent: Aug. 22, 1989

[54] DECORATIVE FAN ASSEMBLY

[76] Inventor: Charles S. Vinson, Empty Walls; 2723 McKinney Ave., Dallas, Tex. 75204

[21] Appl. No.: 147,896

[22] Filed: Jan. 25, 1988

[51] Int. Cl.[4] ..... A45B 27/00; E06B 3/94

[52] U.S. Cl. ..... 160/134; 428/12; 428/124; 126/546

[58] Field of Search ..... 428/12, 124; 160/134; 126/202; 416/70 A, 73

[56] References Cited

U.S. PATENT DOCUMENTS 4,564,538 1/1986 Scholtz ..... 428/12

*Primary Examiner*—Alexander S. Thomas

*Attorney, Agent, or Firm*—Shlesinger & Myers

[57] ABSTRACT

A decorative fan assembly comprising a screen member of pleated segments which may be opened to form a fan shape design, a flat, elongated, rigid base engaged with the fan-shaped screen, a brace connecting the central portions of the base and screen, and a harness assembly comprising a flexible cord having lock tabs secured at intervals thereof, the tabs being engaged with complemental locking members secured to the screen segments for maintaining the screen segments in proper position.

24 Claims, 4 Drawing Sheets

DECORATIVE FAN ASSEMBLY

BACKGROUND OF THE INVENTION

This invention relates to a decorative fan/screen assembly which is adapted for use as a free standing or wall mounted ornamental unit.

Decorative fans and screens of different materials have been widely used in homes and other building areas, illustrative of which is the free standing folding wrought metal fire screen disclosed in U.S. Pat. No. 300,930 issued June 24, 1884, for use in a fireplace. Another ornamental article of this same general design is disclosed in U.S. Pat. No. 4,027,057 issued May 31,1977 on a wall mounted sunburst wall plaque made of fan foldable wood slats. More recently, U.S. Pat. No. 4,564,538 issued Jan. 14, 1986, discloses a decorative fireplace fan made of a pleated piece of foil and paper which is folded into a fen shape, and the gathered end thereof secured to a plate.

SUMMARY OF THE INVENTION

The present invention is a decorative fan assemnly which comprises one or more pieces of sheet material of cardboard or other stiff material which is capable of being folded, the sheet material being pleated to form segments and then engaged with an elongated flat base member, and arraanged in a fan shape.

The outer face of the fan shaped sheet material may bear any decorative material thereon, such as colors, designs, art reproductions, etc. in order to afford the widest possible appeal to prospective purchasers.

The central portion of the pleated sheet material is fixedly engaged with the center of the base by a brace, and a harness assembly extends along an intermediate portion of the rear face of the fan, and is connected to the pleated portions thereof at intervals. This enables the assembly to remain in position as a freestanding unit on a floor, or to be readily mounted on a wall by means of hooks carried by the rear face of the assembly.

When not in use, the assembly may be readily stored by disengaging the pleaated sheet material from the base, collapsing the sheeted material into a stack, and placing the parts together in a box.

DESCRIPTION OF FIGURES OF THE DRAWINGS

FIG. 16 is a view similar to FIG. 15, showing the harness locking member assembled, and.

DETAILED DESCRIPTION OF THE INVENTION

The decorative fan assembly of the present invention generally comprises a screen 20 which is mounted on an elongated base 22.

Figure 4:
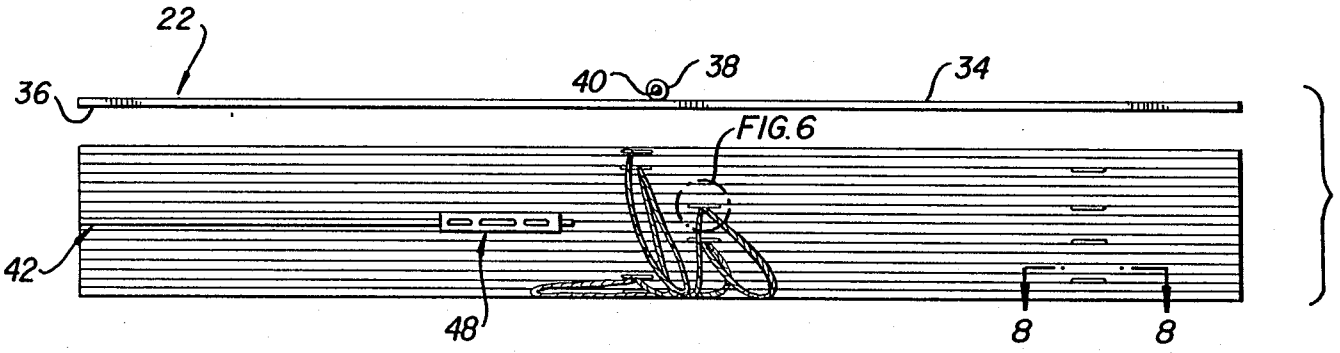
FIG. 4 is an elevational view of the assembly of the present invention in collapsed condition for storage.
Figure 5:
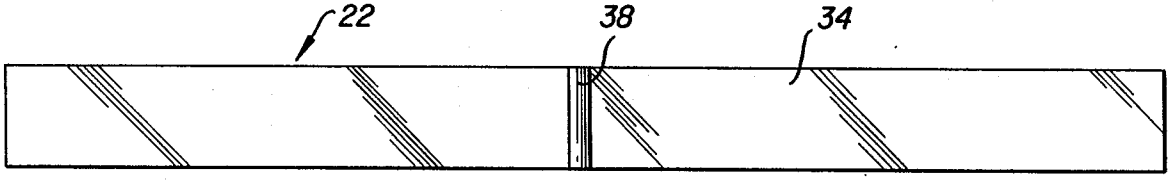
FIG. 5 is a top elevational view of the flat elongated base forming a part of the present invention.
Figure 7:
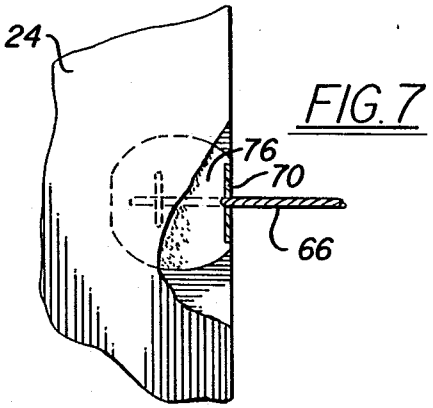
FIG. 7 is a sectional view taken aling the line 7—7 of FIG. 6, looking ing the direction of the arrows.
Figure 6:
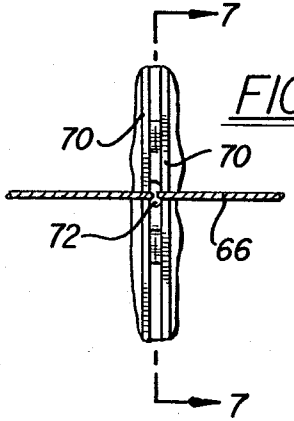
FIG. 6 is an enlarged elevational view showing to advantage a locking member forming a part of the present invention.
Figure 8:
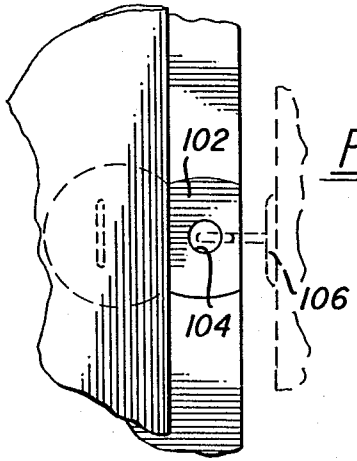
FIG. 8 is an enlarged elevational view of a tab for mounting the assembly on a wall.

Screen 20 comjprises a rectangular sheet of stiffened material, such as cardboard, which is capable of being folded, the cardboard being folded at predetermined intervals to provide a plurality of uniform segments 24 separated by fold lines 26, thereby forming a series of pleats so that, when the sheet material is stored, the pleats thereof will assume the stacked position shown in FIG. 4.

The rectangular sheet material from which screen 20 is formed may be of a single piece of material, or a series of panels which are joined together by staples, adhesive, or other suitable securing means.

In accordance with the present invention, the screen is opened for assembly in a well known manner by holding one end thereof and flaring the remaining portion thereof outwardly into a fan shape.

Elongated base 22 is made of a flat rigid material and includes a body portion of rectangular shape having a top face 34 and a bottom face 36. Top face 34 is provided with a cylindrical member 38 extending transversely of the center portion of the base, the cylindrical member being provided with a bore 40 extending axially through the cylindrical member.

Figures 1, 3:
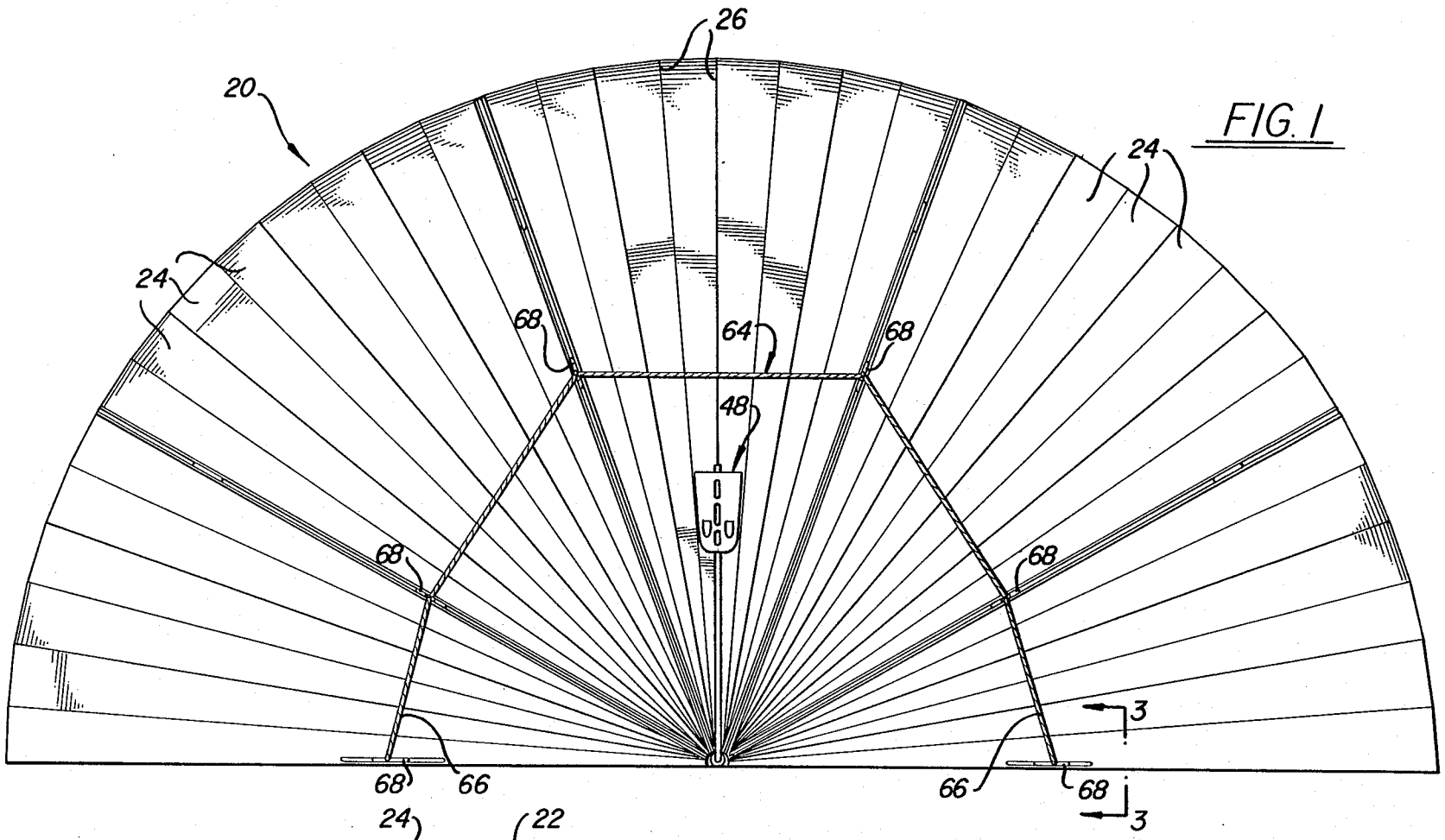
FIG. 1 is a rear elevational view of the decorative fan assembly of the present invention.
FIG. 3 is a sectional view taken along the line 3—3 of FIG. 1, looking in the direction of the arrows.

Screen 20 is attached to elongated base 22 by first placing the screen on a supporting surface with the outer face downwardly, and then opening the screen to a fan shape. Elongated base 22 is placed on the screen in such a manner that half of the elongated base is placed on the second segment of each side of the screen and, in this connection, it is noted that the width of elongated base 22 is substantially equal to the width of the segment. The screen is then wrapped around base 22 so that the segments engage the upper and lower faces thereof, as shown in FIG. 3.

In order to maintain screen 20 in erected position on elongated base 22, there is provided an L-shaped brace generally designated 42 which comprises a short horizontal portion 44 and an elongated vertical portion 46. Short horizontal portion 44 of brace 42 is adapted to be inserted into bore 40 of cylindrical member 38, so that vertical portion 46 extends upwardly adjacent the central portion of screen 20, where it engages a brace locking member generally designated 48. Brace locking member 48 is illustrated to advantage in FIGS. 9 to 12, and includes a first locking portion 50, preferably made of a flat stiff material such as vinyl plastic, which portion is provided with a pair of laterally spaced slits 52 intermediate the height thereof. An adhesive 54 is applied to the upper edge of portion 50 so that, when portion 50 is folded along a vertical fold line between slits 52, adhesive 50 will cause adherence thereof to adjacent segments 24 of screen 20, as shown in FIGS. 11 and 12.

Brace locking member 48 further includes a second locking portion 56, also made of vinyl plastic and including laterally spaced arcuate slits 58, thereby forming locking tabs 60.

Figure 11:
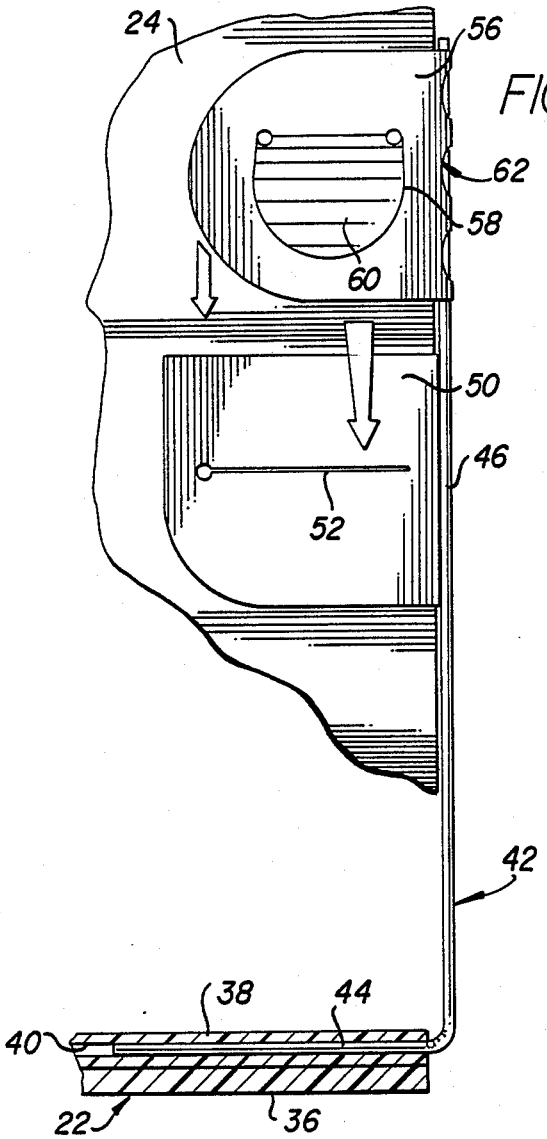
FIG. 11 is a side elevational view of the locking member and complemental means of FIGS. 9 and 10, illustrating their use thereof, and showing the locking members in inoperative position.

Intermediate tabs 60 there are provided a plurality of vertically aligned openings 62 so that, when the second locking portion is folded in half, as shown to advantage in FIG. 11, a tubular hinge is formed which is adapted to receive vertical portion 46 of L-shaped brace 42.

Figure 12:
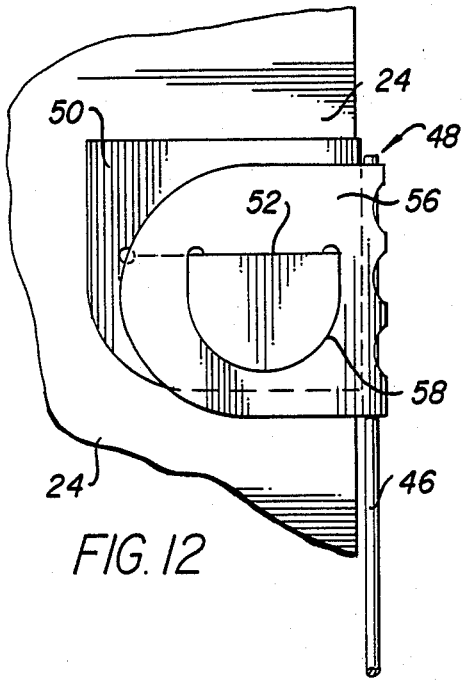
FIG. 12 is a view similar to FIG. 11, showing the locking member and complemental locking means in operative position.

As shown in FIG. 12, screen 20 is fixed to elongated base 20 by inserting locking tabs 60 of second locking portion 56 into slits 52 of first locking portion 50, the locking tabs then being positioned in pockets formed between first locking portion 50 and segment 24 to which the first locking portion is attached. In this position, screen 20 is held in fixed perpendicular relationship to elongated base 22.

The present invention further includes a harness assembly generally designated 64 engaged with an intermediate part of the screen from one extremity to the other, to maintain the screen segments in proper, spaced relationship.

In the form of invention illustrated in FIGS. 1 to 14, harness assembly 64 includes a cord portion 66 of predetermined length, made of nylon or other suitable material which cord may be of a single length, or several pieces connected together. Cord 66 is connected at intervals to tabs 68, each of which includes a pair of circular portions 70 which are folded together in superimposed relationship, and provided with an opening 72 along the fold line through which cord 66 may pass. The cord is secured between the superimposed portions of tabs 68 by adhesive and/or staples, or by any other suitable means. Tabs 68 are secured to pleated segments 24 by adhesive and/or staples, of by other suitable means.

End tabs 68 are engaged with strategically positioned locking members 74, each of which comprises a flat body portion 76 which is fixed to that segment 24 of screen 20, which, in the assembled position, lies in engagement with the upper face of elongated base 22. Engagement of tabs 68 with locking members 74 is effected by means of slits 78 in body portions 76 which are aligned with slits in screen segment 24.

Tabs 68 are inserted through slits 78 in body portion 76 and through complemental aligned slits in screen segment 24, so that, in the operative position, the tabs lie between screen segment 24 and base 22.

Figure 15:
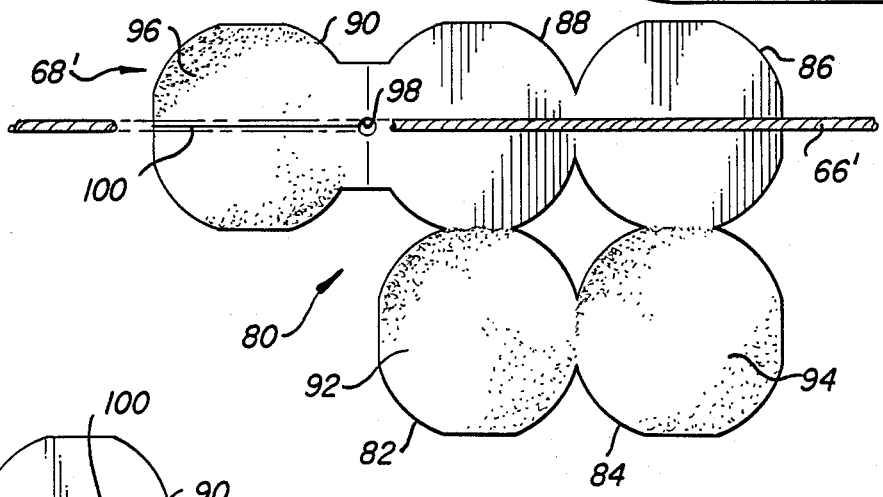
FIG. 15 is and elevational view of a midified form of a harness locking member prior to assembly.
Figure 16:
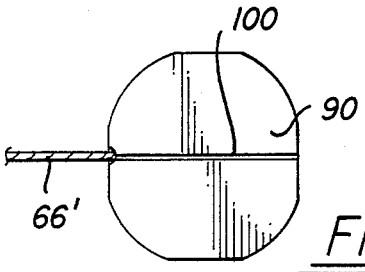

In FIGS. 15 and 16, there is illustrated a modified form of locking tab 68′ for the harness assembly, which includes interconnected portions of generally circular shape designated 82, 84, 86, 88 and 90, portions 82 and 88 being in opposed relation to each other and portions 84 to 86 being in opposed relation to each other. Portions 82, 84 and 90 are further provided with an adhesive on one face thereof, as indicated at 92, 94 and 96 respectively.

There is further provided a cord opening 98 between portions 88 and 90, adjacent which is a slit 100 which extends from opening 98 longitudinally through tab portion 90.

As shown to advantage in FIG. 15, cord 66′ is engaged with tab 68′ by laying the cord along the longitudinal axis of tab portions 86, 88 and 90. Tab portions 82 and 84 are then folded into a superimposed relation with tab portions 88 and 86 respectively, so that they are secured thereto by ashesive 92 and 94. The secured tab portions 84 and 86 are then folded into superimposed relationship with folded tab portions 82 and 88. To complete the formation of the tab, tab portion 90 is then superimposed on the stacked tab portions 82, 84, 86 and 88, and cord portion 66′ is permitted to extend through opening 98 by virtue of slit 100 which permits the cord to pass therethrough. Adhesive 96 holds the stacked tab portions in position for use.

Figure 17:
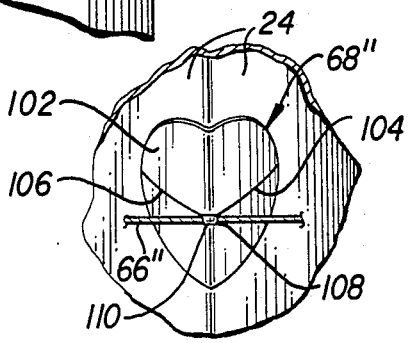
FIG. 17 is an elevational view of another modified form of a harness locking member in assembled position.

In FIG. 17, there is illustrated another modified form of locking tab for the harness assembly which is designated 68". Locking tab 68" comprises a body 102 of generally circular shape which is privided with a pair of aligned slits 104, 106 extending from the outer periphery of the body to a point proximate the center therefir where they are enlarged to form circular openings 108, 110.

In this form of the invention, cord 66" of the harness assembly is comprised of one single length and is adapted for connection with each locking tab 68" by passing cord 66" through slots 104, 106 to circular openings 108, 110.

Locking tabs 68" are then secured to sheet 20 by adhesively securing each locking tab thereto by folding the locking tab vertically for engagement with two adjacent sheet segments, as shown in FIG. 17.

With this form of the invention, cord 66" is passed through circular openings 108, 110 and frictionally engages that portion of each locking tab 68" surrounding the openings to hold the adjacent segments of the screen in predetermined spaced relationship. By virtue of the frictional engagement of cord 66" with the locking tabs and the tautness of the cord, the distance between adjacent segments may be readily varied by manupulating of the cord extending through the locking tabs.

Figure 2:
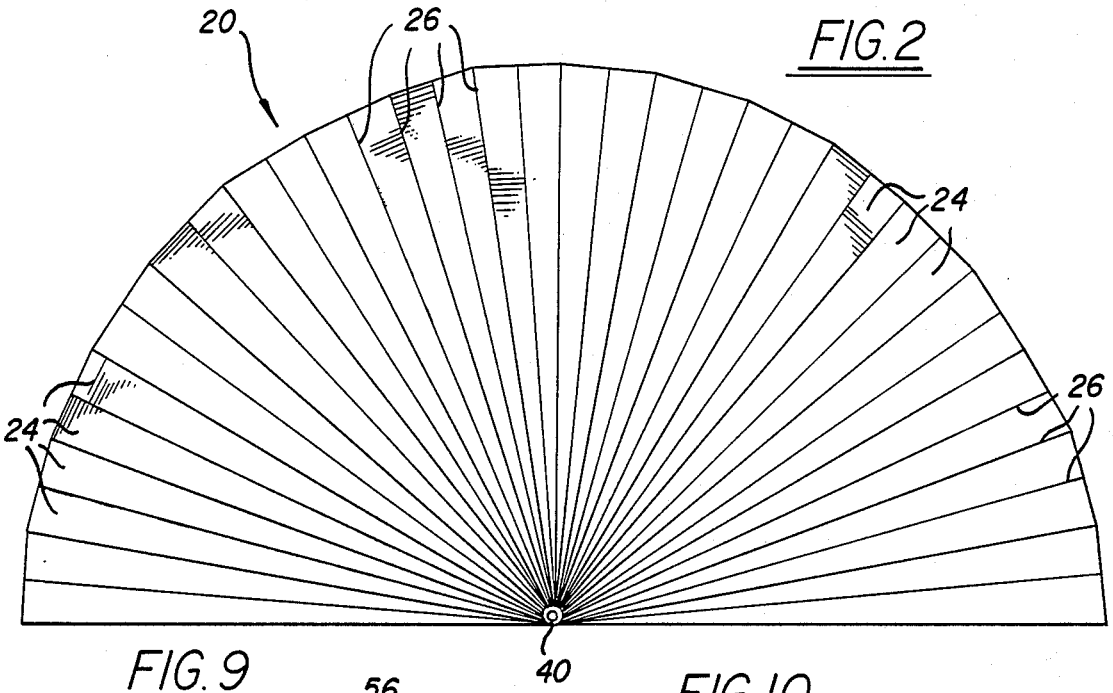
FIG. 2 is a front elevational view thereof.
Figure 9:
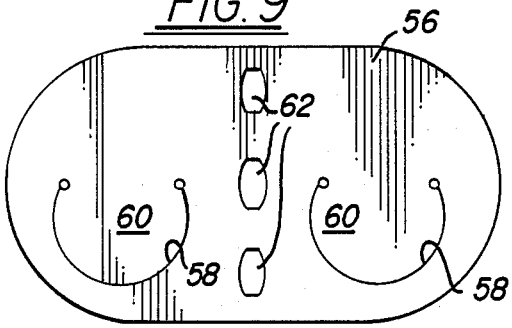
FIG. 9 is a plan view of a brace locking member forming a part of the present invention.
Figure 10:
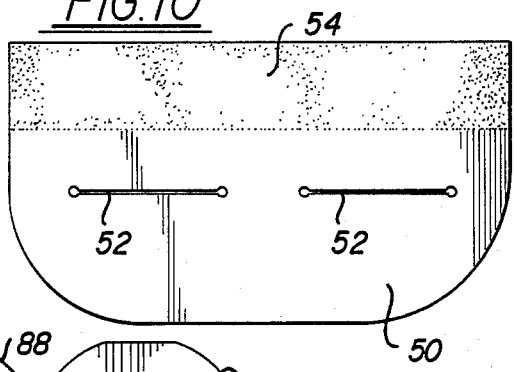
FIG. 10 is a plan view of complemental locking means for the brace locking member of FIG. 9.

In assembly of the present invention, screen 20 is placed on a large surface with the decorative side thereof facing downwardly. The screen is then pulled open into fan or half circle shape. Elongated base 22 is placed on the second segment 24 of screen 20 with top face 34 and cylinder 38 facing downwardly. Segments 24 are folded around the base to effect engagement of the first segment of the screen with bottom face 36, engagement of the second segment of the screen with top face 34, and with the third segment of the screen lying beneath the first segment thereof. As shown in FIGS. 1 and 2, the lower portions of the screen segment lie on opposite sides of cylinder member 38.

Short horizontal portion 44 of L-shaped brace 42 is inserted into bore 40 of cylindrical member 38, following which locking tabs 60 of second locking portion 56 is inserted into slits 52 of first locking portions 50 of the brace locking member, as shown to advantage in FIGS. 11 and 12.

Figure 14:
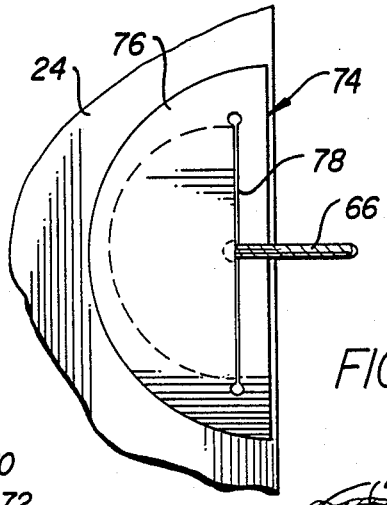
FIG. 14 is a view similar to FIG. 13, showing the harness locking member in locked position.
Figure 13:
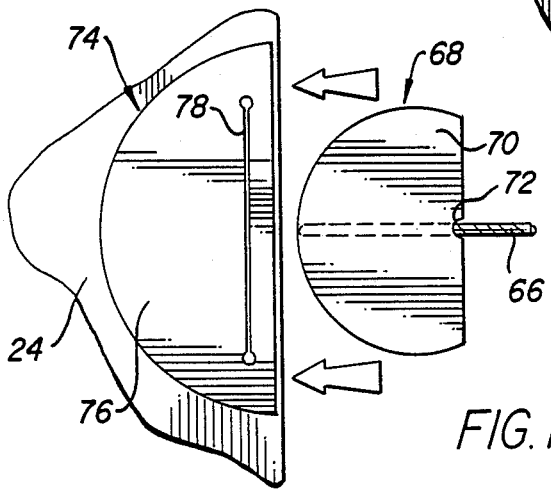
FIG. 13 is an elevational view of a harness locking member, illustrating its use, and showing the locking member in inoperative position.

Ends tabs 68 of harness assembly 64 are then inserted through slits 78 of locking member 74, as shown in FIGS. 13 and 14.

The assembled decorative fan/screen assembly may then be placed in a freestanding position on any supporting surface for use as fireplace covers, fireplace mantles, floor decorations, etc.

It is further in accordance with the present invention to provide a series of tabs 102 secured at intervals to the rear of screen 20, which tabs are provided with openings 104 for engagement with a wall hook 106 for hanging the present assembly on a wall, either alone or in combination with another assembly to produce a circular ornamental assembly.

The assembly of the present invention may be readily disassembled by reversing the assembly steps set out above, so that the segments comprising the screen may be stacked as shown in FIG. 4, thereby permitting the same to be readily stored when not in use.

While there has herein been shown and described the presently preferred forms of this invention, it is to be understood that such has been done for purposes of illustration only, and that various changes may be made therein with the scope of the appended claims.

What is claimed is:

1. A decorative fan assembly including
(a) a sheet member of stiff foldable material;
(b) said sheet member being folded at intervals to provide a plurality of pleated segments which are gathered at one end to assume a fan shape;
(c) an elongated base of flat rigid material in supporting engagement with the end segments of the pleated sheet member;
(d) a first means engaging said sheet member with said elongated base, and
(e) a second means fixedly connecting an intermediate portion of said fan shaped sheet member to said elongated base for holding the latter upright on the base.

2. The decorative fan assembly of claim 1, wherein
(a) said sheet member is of unitary construction.

3. The decorative fan assembly of claim 1, wherein
(a) said sheet member comprises a plurality of panels, and
(b) a third means for securing the lateral ends of said panels together.

4. The decorative fan assembly of claim 1, wherein
(a) said elongated base is of flat rectangular shape, the width of said base being substantially equal to the width of said segments, the lower segments of said sheet member being wrapped around said flat elongated base to effect engagement therewith.

5. The decorative fan assembly of claim 1, wherein
(a) said second means comprises a brace of rigid construction;
(b) one end of said brace being connected to said elongated base, and the other end thereof being connected to a central portion of said sheet member intermediate the height thereof.

6. The decorative fan assembly of claim 5, wherein
(a) said flat elongated base includes a tubular portion extending transversely of the central part thereof, and
(b) said brace comprises an L-shaped arm, the horizontal end of said arm being inserted into the tubular portion of said elongated base.

7. The decorative fan assembly of claim 6, with the addition of
(a) a connecting member fixedly engaged to a central portion of said sheet member;
(b) said connecting member comprising flat tabs secured to adjacent segments of the pleated sheet member, and
(c) hinge means connecting said flat tabs together at the point where the sheet member is pleated to form the segments;
(d) said hinge means including a tubular portion to receive the upper end of said L-shaped arm.

8. The decorative fan assembly of claim 1, with the addition of
(a) a third means of flexible construction positioned across an intermediate portion of said fan-shaped sheet member between the ends thereof; and
(b) a plurality of spaced tabs engaged with said third means at predetermined intervals, and
(c) a fourth means for securing said tabs to said pleated segments of said sheet member at predetermined intervals.

9. The decorative fan assembly of claim 8, with the addition of
(a) complemental locking means affixed to the pleated segments of said sheet member adjacent said elongated base;
(b) each of said complemental locking means comprising a flat tab provided with a transverse slit, which is aligned with a complemental slit in the screen segment, a pair of said spaced tabs being inserted through the slits of said complemental locking means into engagement with said elongated base.

10. The decorative fan assembly of claim 8, wherein
(a) said third means comprises a cord.

11. The decorative fan assembly of claim 10, wherein
(a) said cord is fixedly secured to said spaced tabs.

12. The decorative fan assembly of claim 10, wherein
(a) said cord is of continuous length and is frictionally engaged with said spaced tabs, to permit variation in the distance between adjacent tabs and resultant adjustment of the distance between adjacent pleated segments of said sheet member.

13. The decorative fan assembly of claim 8, wherein
(a) each of said spaced tabs comprises at least two flat superimposed portions of substantially the same shape;
(b) said cord being interposed between said superimposed portions.

14. The decorative fan assembly of claim 13, wherein
(a) each of said tabs comprises two pairs of like, interconnected portions;
(b) said pairs of interconnected portions being arranged in opposed relationship, whereby said cord may be positioned longitudingly of one pair of tab portions and held in place by folding the opposed pair of tab portions into superimposed relationship, and
(c) a fifth means for securing said superimposed pairs of tab portions together.

15. The decorative fan assembly of claim 14, wherein
(a) said pairs of interconnected superimposed tab portions are folded into superimposed relationship to form a unitary tab, and position the portions of the cord extending through the locking tabs in side-by-side relationship, and
(b) a sixth means for securing said superimposed tab portions in contiguous relationship.

16. The decorative fan assembly of claim 15, wherein
(a) said sixth means for securing said superimposed tab portions together comprises an additional tab portion connected to one of said pairs of tab portions;

(b) said additional tab portion being folded over said superimposed pairs of tab portions, and
(c) a seventh means for securing said additional tab portion to said superimposed pairs of tab portions.

17. The decorative fan assembly of claim 16, wherein
(a) said additional tab portion is provided with a longitudinal slit to enable the portions of the cord entering and leaving the tab to be in side-by-side relationship.

18. A decorative fan assembly including
(a) a sheet member of stiff, foldable material;
(b) said sheet member being folded at intervals to provide a plurality of pleated segments which are opened to a fan shape;
(c) an elongated base of flat, rectangular shape, the width of said base being substantially equal to the width of said segments, the lower segments of fan-shaped sheet member being wrapped around said elongated base to effect engagement therewith;
(d) said elongated base including a cylindrical member extending transversely of the central part thereof, said cylindrical member being provided with an axial bore;
(e) a brace of rigid construction connecting said elongated base to said fan-shaped sheet member;
(f) said brace including an L-shaped arm, comprising a horizontal portion and a vertical portion, said horizontal portion being inserted into the axial bort of said cylindrical member;
(g) a brace locking member comprising a first locking portion secured to an intermediate part of said sheet member;
(h) a second locking portion engaged with the vertical portion of said L-shaped arm;
(i) said second locking portion being lockingly engaged with said first locking portion to effect fixed engagement of sheet member with said elongated base;
(j) a harness assembly comprising a flexible cord having spaced locking tabs connected at predetermined intervals to said cord, said harness assembly being positioned across an intermediate portion of said fan-shaped sheet member between the ends thereof, and
(k) means for securing said spaced locking tabs to the pleated segments of said sheet member.

19. The decorative fan assembly of claim 18, wherein
(a) said first locking portion of said brace locking member comprises a flat body of stiff, foldable material;
(b) said body having a pair of laterally spaced horizontal slits, said body being folded vertically to effect engagement of each slit part of the body with adjacent sheet member segments;
(c) means for adhesively securing said body to said sheet member segments;
(d) said second locking portion comprising a body having a pair of laterally spaced arcuate slits, forming locking tabs adapted to be inserted through the slits of said first locking portion body;
(e) said body being provided with a series of spaced vertically aligned openings between said locking tabs, whereby, when said second locking portion body is folded along the vertically aligned openings, a tubular hinge is formed into which the vertical portion of said L-shaped brace is inserted.

20. The decorative fan assembly of claim 19, with the addition of
(a) spaced mounting tabs secured to said screen segments for hanging said assembly on a wall.

21. The decorative fan assembly of claim 18, wherein
(a) each of the spaced locking tabs of said harness assembly comprises at least two like, superimposed portions;
(b) said cord being interposed between said superimposed portions, and
(c) a second means for engaging said superimposed portions with said cord.

22. The decorative fan assemnly of claim 21, wherein
(a) said cord is fixedly secured to said spaced locking tabs.

23. The decorative fan assembly of claim 21, wherein
(a) said cord is continuous and is frictionally engaged with said spaced locking tabs, to permit variation in the distance between adjacent locking tabs and resultant adjustment of the distance between adjacent pleated segments of said sheet member.

24. The decorative fan assembly of claim 21, wherein
(a) each of said locking member flat locking tabs comprises two pairs of opposed interconnected tab portions, said cord being positioned longitudinally of one pair of tab portions and held in place by folding the opposed pair of tab portions into superimposed relationship therewith;
(b) means for securing said superimposed pairs of tab portions together;
(c) said pairs of interconnected tab portions being folded into superimposed relationship to form a unitary tab, and to position the portions of the cord extending through the locking tab in side-by-side relationship, and
(d) an additional tab portion connected to said two pairs of interconnected tab portions and dolded over said superimposed tab portions, said additional tab portion having a longitudinal slit to enable the portions of the cord entering and leaving the tab to be in side-by-side relationship, and
(3) means for securing said additional tab portion to said superimposed pairs of tab portions.

* * * * *